United States Patent [19]

Dubow

[11] Patent Number: 4,974,894

[45] Date of Patent: Dec. 4, 1990

[54] GOLF BALL RETRIEVING DEVICE

[76] Inventor: Irvine L. Dubow, 7220 York Ave. S., Apt. 322, Edina, Minn. 55435

[21] Appl. No.: 522,656

[22] Filed: May 14, 1990

[51] Int. Cl.[5] ..... A63B 47/02

[52] U.S. Cl. ..... 294/19.2; 56/400.18

[58] Field of Search ..... 294/19.1, 19.2, 24, 294/99.1; 56/328.1, 400.11, 400.18, 400.19; 273/32 B, 32 F, 162 B, 162 E, 162 F

[56] References Cited

U.S. PATENT DOCUMENTS

| | | | |
|---|---|---|---|
| 466,650 | 8/1984 | Roedel | 294/19.2 |
| 2,904,951 | 9/1959 | Glover | 56/400.18 |
| 3,306,650 | 2/1967 | Zagwyn | 294/19.2 X |
| 3,318,628 | 5/1967 | White | 294/19.2 |
| 3,701,243 | 10/1972 | Durkee | 56/400.18 |
| 4,236,742 | 12/1980 | Florence | 294/19.2 X |
| 4,254,981 | 3/1981 | Wilson | 294/19.2 |
| 4,466,650 | 8/1984 | Zimmers | 294/19.2 |

*Primary Examiner*—Johnny D. Cherry
*Attorney, Agent, or Firm*—Leo Gregory

[57] ABSTRACT

A golf ball retrieving device to withdraw a golf ball from a water hole providing an extensible reach and an expandable cage to receive and entrap a golf ball therein for recovery by the operator.

7 Claims, 2 Drawing Sheets

15
12
10
14
16
21
30b
28
17
28e
22
31b
31
32
33
34
35
11

14
16
20
30
30b
16c
16b
28b
18
19
22
35d
35c
35b
35e
35a
35

16b
16c
20
30a
21
33d
28d
28
33c
22a
22
33

GOLF BALL RETRIEVING DEVICE

BACKGROUND OF THE INVENTION

1. Field of the Invention

This invention relates to an extensible handled tool for recovery of a golf ball from a water hazard on a golf course.

2. Description of the Previous Art

Known in the prior art are various handled devices for the retrieval of a golf ball from a water hazard on a golf course.

Indicative of the prior art is U.S. Pat. No. 3,318,628 to H. M. White which discloses a small collapsible cage which can be withdrawn into its handle and which is inserted into a golf hole to withdraw the ball.

In U.S. Pat. No. 4,466,650 to M. F. Roedel, a ball retriever similar to that above is disclosed at one end of a handle and having a mounting at its other end to position a tee in the ground.

In U.S. Pat. No. 4,254,981 to A. C. Wilson, a ball retriever consists of a plurality of uniform tines which may be variably spread apart and which have elongated curved ends to rake a ball out of a water hazard.

It is desirable to have an extensible tool to readily retrieve a golf ball from a water hazard and which will securely hold one or more balls thus retrieved.

SUMMARY OF THE INVENTION

It is an object of this invention to provide a cage-like device which enables an operator to readily retrieve a golf ball from some distance out into a water hazard on a golf course.

It is a further object herein to provide a device which securely entraps a ball once it is picked up with said device.

More particularly, it is an object of this invention to provide a device for the retrieval of a golf ball from a water hazard, the device having an expandable open-sided cage and an extensible handle, the cage comprising a plurality of prongs having inwardly angled ends with the prongs forming more than one pocket within a chamber therein and which securely entraps one or two retrieved balls until they are removed by the operator.

These and other objects and advantages of the invention will be set forth in the following description made in connection with the accompanying drawings in which like reference characters refer to similar parts throughout the several views.

DESCRIPTION OF A PREFERRED EMBODIMENT

Figures 1, 2, 3:
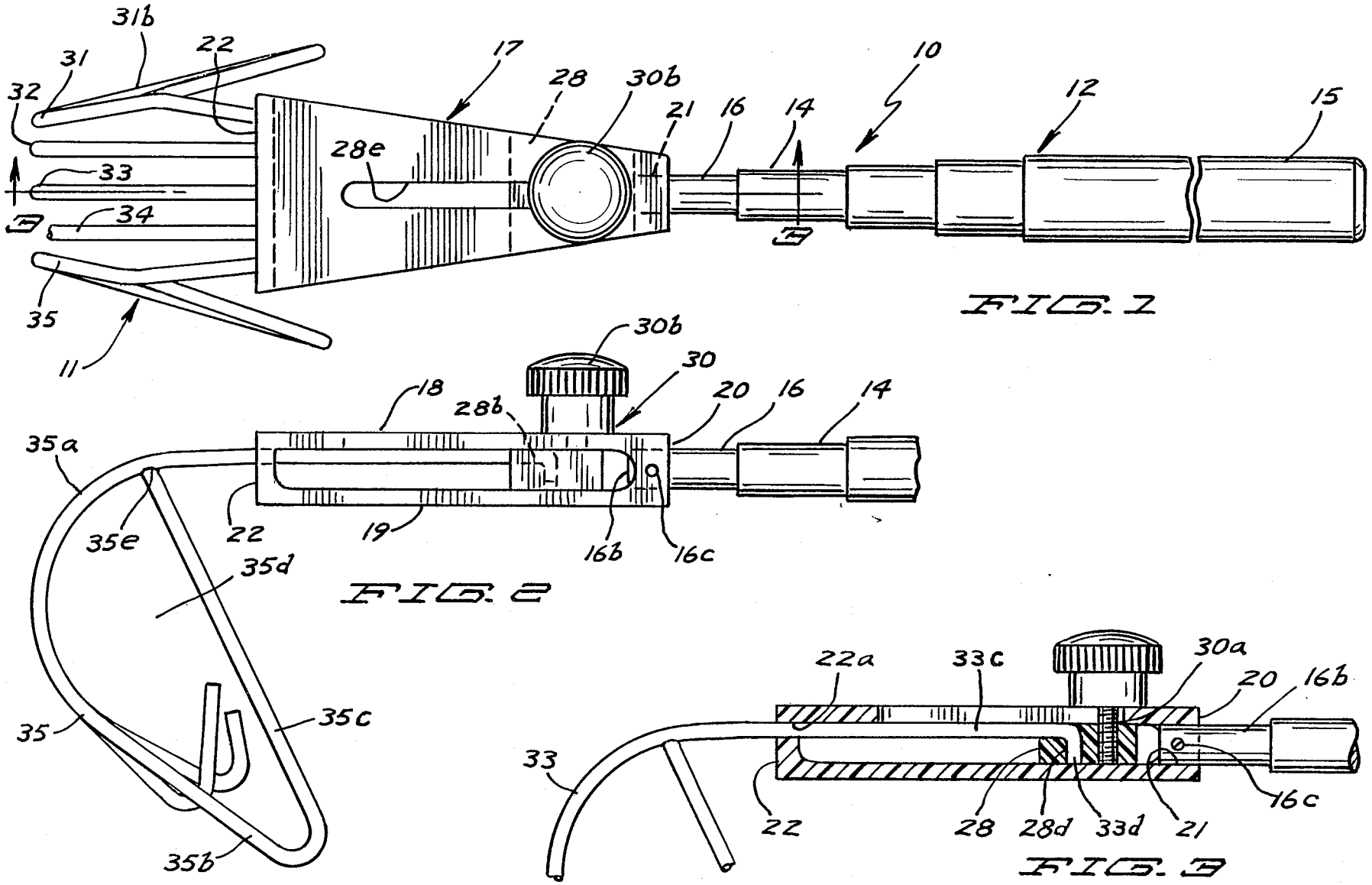
FIG. 1 is a top plan view with a portion thereof being broken away.
FIG. 2 is a view similar to that of FIG. 1 in side elevation.
FIG. 3 is a broken view in vertical section taken on line 3—3 of FIG. 1 as indicated.

The invention herein is a device intended to be used to recover golf balls from water holes or water hazards on a golf course. The device is indicated generally by the reference numeral 10.

Referring to FIG. 1, said device 10 consists of a cage or cage-like member 11 mounted, as will be described, at one end of a telescopic handle 12 which may be extended as required such as up to a length of twenty or twenty-five feet.

The handle is of a conventional tubular structure such as formed of an aluminum or other suitable lightweight metal extensible tubes and requires no description as to its makeup or function. However, at the hand holding end of said handle there is mounted a hand grip 15 formed of a suitable plastic or rubber material much like the hand grip on the handlebars of a bicycle.

At the forward end of said handle, there is a terminal segment 16 and with preceding like segment portions such as 14 is fully drawn into the handle 12 in a retracted position.

Attached to said segment 16 is an elongated frame-like housing or casing 17 substantially rectangular in form having spaced upper and lower walls 18 and 19 which taper in the direction of said handle and are joined at their front and rear ends by a front wall 22 and a rear wall 20, the rear wall having an aperture 21 therein into which the adjacent end **16*b* of said segment 16 is disposed and suitably secured as by a pin 16*c*. Said end wall 20 will have sufficient thickness to secure said segment 16**.

The forward or front end wall 22 of said housing is seen to be substantially wider than said rear wall 20 and is apertured in a horizontal line thereacross by holes or passages **22*a*** of which those at each side of the center one are angled outwardly in a diverging fan-like arrangement as shown.

Disposed within said housing 17 for longitudinal sliding movement therein is a mounting block 28 tapering rearwardly to correspond to the taper of said housing 17, thus having a flared front end portion **28*a*. Formed into the upper surface portion 28*b* of the front end portion 28*a* are a number of diverging fan-like grooves 28*c* with each terminating at its inner end in a vertical bore 28*d***. In the present embodiment five grooves are shown.

Formed in the upper wall 18 of said housing 17 and extending centrally longitudinally therein is a slot **28*e* through which extends a knob 30 which has its inner end portion 30*a* suitably threaded onto said mounting block 28 and which has an enlarged head portion 30*b* extending above said upper wall 18 and has free movement the length of said slot. Said knob is threaded down to lockingly engage said upper wall 18**.

Mounted onto or secured to said block 28 is an open ended cage-like ball retrieving member 11. Said member 11 comprises a number of transversely disposed radially diverging prongs 31–35 as here shown. Said prongs have spacing therebetween less than the diameter of a golf ball. The inner end portions of said prongs as at **33*d* are bent at right angles whereby the straight rearward end portions of said prongs as at 33*c* are seated in said grooves 28*c* and their right angled end portions as at 33*d* are disposed into corresponding ones of said vertical bores 28*d*** as indicated.

Now, with particular reference to said prongs, said prongs are in non-uniform groups. The outward pair of said prongs, namely prongs 31 and 35, have a greater downward or lengthwise projection than the others as shown in FIG. 2 and each prong describes an intermediate curvature as indicated and represented at 35*a* and then flattens out into a straight segment as at 35*b* and is then angled upwardly as at 35*c* with a straight segment extending substantially to the beginning of said curvature to form a closed loop 35*d* and is there secured as by welding at 35*e*. The loops thus formed are of a size such that a golf ball will not pass through. These loops form the side walls of the cage.

The pair of prongs 32 and 34 inwardly of and respectively adjacent to said prongs 31 and 35 project downwardly somewhat less than said prongs 31 and 35 and have a substantially corresponding curvature as at 32*a* and 34*a* with respect to the corresponding curved portions of the prongs 31 and 35 and have their inner ends respectively forming upwardly angled or hook portions 32*b* and 34*b*; however, their lower straight portions as at 34*c*, extend outwardly slightly more than corresponding portions of 31*b* and 35*b*.

Figure 5:
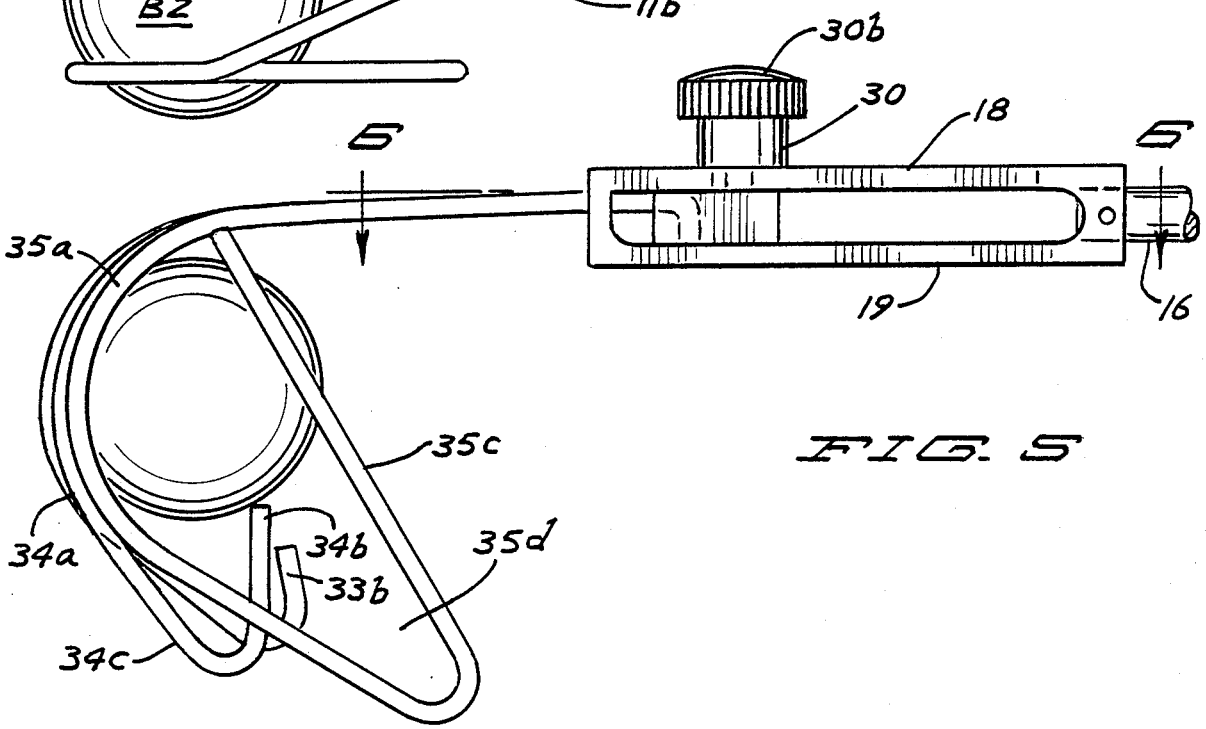
FIG. 5 is a side elevational view in an operating position similar to that of FIG. 4 with a portion being broken away.
Figure 6:
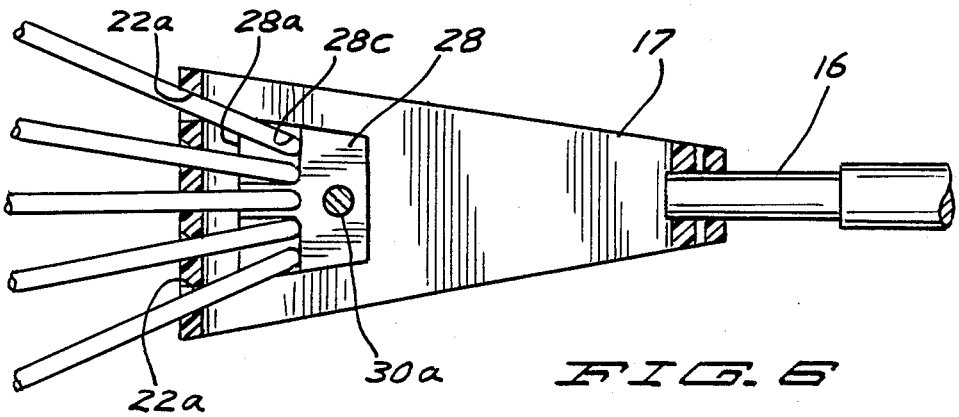
FIG. 6 is a broken view in horizontal section taken on line 6—6 of FIG. 5 as indicated.

The center prong 33 has a somewhat less curvature and has its straight portion 33*a* angled inwardly more than the corresponding portions of the prongs 32 and 34 as in FIG. 5 and its inner end portion is angled upwardly at 33*b* somewhat more acutely than said ends 32*b* and 34*b*.

It has been found that for very good performance the hook portions of the prongs 32 and 34 are on the order of one and one quarter inches in length and angled upwardly at approximately 42° and the center prong has its angled end portion approximately one-half inch in length and angled at approximately 26°.

Figure 4:
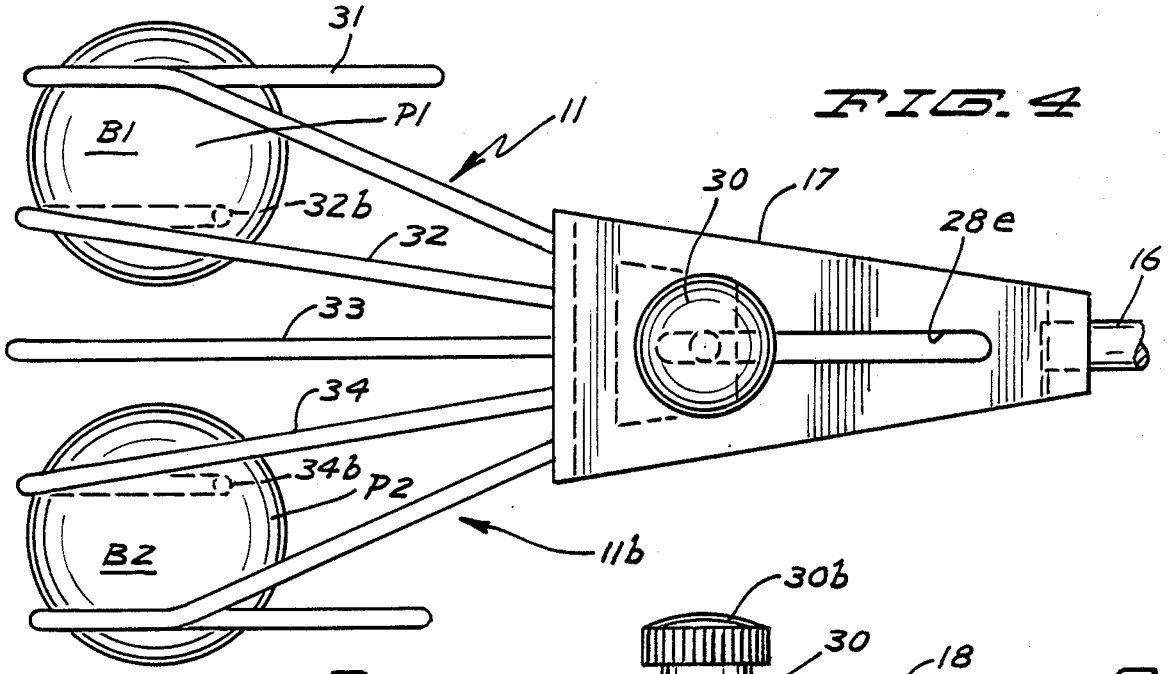
FIG. 4 is a view similar to FIG. 1 in top plan in expanded operating position showing a pair of golf balls entrapped therein.

Thus as described, said cage is formed to have in effect one pocket P1 formed by the prongs 31–33 and a second pocket P2 formed by the prongs 33–35. Balls such as B1 and B2, entrapped by said cage, will gravitate to and rest in one or the other of said pockets or, if so utilized, the cage will readily receive and entrap two balls, as shown in FIG. 4. The cage as thus formed may be said to have an open side 11*b* for the passage of a ball thereinto.

The hook portions of the prongs 32–34 very nicely hold a ball or balls in a trapped position. Upon retrieval, the operator merely turns the cage to have its open side face downwardly and pluck the balls out.

Next will be described the operation of the housing 17 and its internal mounting block 28. As described, the cage member 11 has its respective prongs secured to said mounting block and said prongs extend through the passages or openings 22*a* in the front wall of said housing.

Said mounting block 28 by means of the knob 30 is readily slidable forwardly and rearwardly within said housing 17. As the mounting block is moved forwardly, said prongs diverge and spread out due to the divergence of the passages 22*a* and in order to readily accommodate two golf balls within said cage, the spread is on the order of four inches with the prongs at their widest point of divergence preferably being not more than one inch apart.

For carrying or storage purposes, the knob 30 is moved rearwardly and the cage is contracted.

In operation, the cage will be expanded and the handle will be extended whatever distance is required, within its limits, to reach a ball in a water hole or hazard. The cage will be poised just beyond the ball and lowered to be drawn over the ball. The buoyancy of the ball in the water, or in other words, the force of the water in supporting the ball is sufficient to have the ball enter said cage and the ball is immediately entrapped therein.

The operator then draws the handle and the cage unto himself to readily remove the ball by hand. The ball, or balls as the case may be, are securely held within the cage during retrieval. It is understood that the cage as here described is fully adequate to retrieve two balls either simultaneously or successively.

The retrieving device herein described has proven to be very effective and very easy to use in retrieving balls. Other devices require particular care not to lose a ball in the retrieval operation but with the device herein, once the ball is in the cage, it is securely entrapped and held.

It will of course be understood that various changes may be made in form, details, arrangement and proportions of the product without departing from the scope of the invention which, generally stated, consists in a product capable of carrying out the objects above set forth, in the parts and combination of parts disclosed and defined in the appended claims.

What is claimed is:

1. A device for retrieving a golf ball from a water hole on a golf course, having in combination a telescopic handle, means carrying a ball retrieving member at one end of said handle, said member comprising a cage having an open side and being formed of transversely divergent prongs having curved intermediate portions, an outward pair of said prongs having closed loops, said outward pair of said prongs extending further outward lengthwise than the prongs therebetween, said prongs between said outward pair of prongs having acutely angled terminal hook portions extending into the open side of said cage, the central of said prongs having a more extensive curved portion than the prongs at either side thereof forming pockets therewith, and said means varying the divergence of said prongs.

2. The structure of claim 1, wherein said first mentioned means comprises a longitudinally flared housing having front and rear end walls, said rear wall having an aperture therein, said handle comprising a plurality of retractable segments, the outermost of said segments having an end portion disposed into and secured in said aperture, said housing member having a plurality of forwardly diverging passages extending through said front wall thereof, said prongs having straight portions thereof respectively disposed through said passages, a mounting block member disposed in said housing and movable longitudinally thereof, said mounting block having diverging grooves therein, said grooves each terminating in a vertical bore at the rearward ends thereof, said prongs being respectively disposed in said grooves and having their angled terminal portions disposed in said bores, means extending outwardly of said housing moving said mounting block longitudinally of said housing diverging and retracting said prongs.

3. The structure of claim 2, wherein said housing has a top and bottom wall, and said walls flaring forwardly.

4. A device for retrieving a golf ball from a water hole, having in combination a handle having extensible segments, means carrying a ball retrieving member at one end of said handle, said member comprising a cage having an open side and consisting of a plurality of forwardly diverging prongs, a housing member having a front and rear wall and having diverging passages extending through said front wall, said prongs having straight body portions extending through said passages, said prongs respectively having their rear end portions bent at right angles, a mounting block disposed in said housing, said block being slidable longitudinally of said housing, said mounting block having diverging grooves, each of said grooves having a vertical bore at the inward end thereof relative to said housing, said prongs having rearward portions respectively disposed in said grooves and having their respective angled rear end portions disposed in said bores, the outward pair of said prongs forming closed side loops, the prongs between said outward pair of prongs having acutely angled terminal portions extending inwardly of said open side of said cage, and means extending outwardly of said housing moving said mounting block forwardly and rearwardly of said housing transversely diverging and retracting said prongs.

5. The structure of claim 4, wherein said housing member having a top and bottom wall, a longitudinal slot in said top wall, a knob having a depending portion threaded into said mounting block and extending upwardly of said slot being adapted to move said mounting block longitudinally of said housing to transversely expand and retract said prongs.

6. The structure of claim 4, wherein said outward pair of said prongs extend lengthwise greater than said prongs respectively adjacent thereto.

7. The structure of claim 4, wherein the center one of said prongs has its lower straight portion angled inwardly of said cage somewhat more than that of the adjacent prongs at each side thereof, whereby pockets are formed between said central prong and the outermost pair of prongs.

* * * * *